US006307515B1

(12) United States Patent
Sauer et al.

(10) Patent No.: US 6,307,515 B1
(45) Date of Patent: Oct. 23, 2001

(54) CONTACT DEVICE FOR AN ELECTRICAL FUNCTIONAL ELEMENT DISPOSED ON A WINDOW

(75) Inventors: Gerd Sauer, Stolberg (DE); Helmut Maeuser, Simpelveld (NL)

(73) Assignee: Saint-Gobain Vitrage, Courbevoie (FR)

( * ) Notice: Subject to any disclaimer, the term of this patent is extended or adjusted under 35 U.S.C. 154(b) by 0 days.

(21) Appl. No.: 09/457,329

(22) Filed: Dec. 9, 1999

(30) Foreign Application Priority Data

Dec. 9, 1998 (DE) ..... 198 56 663

(51) Int. Cl.[7] ..... H01Q 1/32
(52) U.S. Cl. ..... 343/713; 343/711; 343/872
(58) Field of Search ..... 343/700 MS, 711, 343/713, 872; H01Q 1/32

(56) References Cited

U.S. PATENT DOCUMENTS 5,343,214 * 8/1994 Hadzoglou ..... 343/713
5,748,155 * 5/1998 Kadunce et al. ..... 343/713
5,959,581 * 9/1999 Fusinski ..... 343/700 MS
6,005,527 * 12/1999 Gomez et al. ..... 343/713
6,054,961 * 4/2000 Gong et al. ..... 343/713
6,087,996 * 7/2000 Dery ..... 343/713

* cited by examiner

*Primary Examiner*—Don Wong
*Assistant Examiner*—Shih-Chao Chen
(74) *Attorney, Agent, or Firm*—Oblon, Spivak, McClelland, Maier & Neustadt, P.C.

(57) ABSTRACT

In a contact device for an electrical functional element, for example an antenna, disposed on a window, in particular on a vehicle window, with a housing fixed on the window and comprising electrical components, such as an amplifier, with an input connection between the housing and the functional element, which is also fixed on the window, and with output links in accordance with the invention, the input connection (104; 204) is, in two different variants, each time surrounded by an adhesive layer, independently of its placement in electrical contact; in one of the variants, it is disposed outside the housing (102), in the other variant it is overlain by the housing (202). The electrical contact to the functional element is effected during or after bonding the housing and respectively the input connection, preferably by soldering, so as to ensure particularly reliable placement in contact.

11 Claims, 2 Drawing Sheets

CONTACT DEVICE FOR AN ELECTRICAL FUNCTIONAL ELEMENT DISPOSED ON A WINDOW

The invention relates to a contact device for an electrical functional element, for example an antenna or a heating apparatus, disposed on a window, in particular on a vehicle window, with a housing fixed on the window and comprising components, for example an amplifier, with an input connection between the housing and the functional element, which is also fixed on the window, and with output links.

The document DE-GM 75 27 621 discloses an antenna for radiophonic reception in motor vehicles, whose antenna conductors are installed on a window. For the direct linking of an antenna amplifier with these antenna conductors, the amplifier is here fitted inside a small housing and the latter in bonded to the window. Two antenna conductors, linked together in a conducting manner inside the housing of the amplifier, are liked directly to the input terminals of the amplifier and moreover also bonded to the window. At its output, the amplifier is connected by a multipole flat cable to the on-board network (supply voltage) and to the receiver apparatus, The flat cable is fixed along the rubber seal of the window, preferably wedged between the seal and the window. other details relating to the nature of the bonded joins do not appear in this document. Likewise, the latter does not describe the type of cables in greater detail.

The document DE-GM 72 20 420 also discloses a window with active antenna, in which an amplification capsule is bonded in a recess of the window and is placed in contact via elements for linking to the input and to the output. The connection between the antenna conductors and the amplification capsule is not discussed therein in greater detail.

The document DS-GM 72 27 083 discloses an arrangement of this type in which the active capsule of the antenna is accommodated in the base housing of an interior rear view mirror fixed to the window.

The document DE-C1-195 36 131 C1 discloses a multiple linking element for windows with antenna, in which several free contact lands and the corresponding conductor segments, mutually insulated, are clustered together on a heat-resistant sheet. The latter is provided, on its face turned towards the corresponding contact field on the window, with a narrow strip for hot bonding, which runs in a straight line, with a relatively small width, perpendicularly to the conductor segments. It can be bonded to the glass surface, before the contact lands are soldered or bonded by means of a conducting adhesive to the corresponding contact lands of the antenna conductors. In this way, the linking element can be positioned and fixed provisionally on the window, which carries the antenna conductors. The bonding strip serves moreover to relieve the tension on the contact zone proper.

It is also known practice (DE-A1-195 33 761) to arrange control circuits for window heating apparatus or automatic windscreen wipers, directly on the window to be heated; this control circuit can for example comprise a moisture detector as well as other switching means such as an amplifier and the like.

Conductors or electrical structures, which are disposed for example on or in a window, are frequently placed lastingly in contact with electrical or electronic components by soft soldering of contact lands made in a corresponding manner. Contacts with plugs or sprung contacts are also known (for example DE 1 196 330, DE-C2-36 04 437). Such contacts by purely mechanical effect are certainly simple to manipulate, however they are also subject to the corrosion of the contacts and to mechanical wear, which is caused for example by vibrations.

The document DE-A1-195 10 186 discloses the practice of linking electrical conductors disposed on a rigid substrate to braided wires of a flat cable, by removing the insulant on one side from the braided wires and by pressing the stripped sections of the latter onto the conductors on the substrate side by means of a clamping piece, with interposition of an adhesive containing electrically conducting particles. In this operation, this latter piece can even be bonded with the substrate and it then overlies the finished contact zone, relieving the tension. When using an adhesive which can be hardened by UV rays, the clamping piece must be made of glass. For regular operation of this contact device, the adhesive must be anisotropically conducting, that is to say the embedded conducting particles cannot effect a conductive connection stretching over too long a distance, so that two or more of two of the conductors to be bonded are not short-circuited.

The objective of the invention is to improve a contact device with a housing and an input connection to the electrical functional element in accordance with the state of the art mentioned in the introduction, in a manner which allows simple and reliable manipulation and mounting and good leaktightness against exterior influences.

In accordance with the invention, this aim is achieved by the characteristics of claim 1 and of the allied claim 7. The characteristics of the secondary claims depending respectively on these independent claims indicate advantageous variants of these objectives.

According to a first solution in accordance with the invention, the housing and the input connection disposed outside the housing to be fixed on the window, are provided, on their face turned towards the functional element, with adhesive layers extending mutually, it being possible for the input connection to be linked by contact lands with corresponding contact lands of the electrical functional element installed on the window independently of the contact device and the corresponding adhesive layer exhibiting at least one recess in the region of the contact lands.

Thus, on the one hand a clear separation is effected between the contact device and the functional element. The contact device and respectively the integrated electrical components therein, such as an amplifier, may consequently be fabricated and tested independently of the functional element placed on the side of the window.

On the other hand, the contact lands are, after the fitting and pressing of the input connection provided with the adhesive layer, protected in a dependably manner against exterior influences such as moisture or soiling. Likewise the adhesive layer offers the contact zone protection against mechanical actions during the mounting of the window and after fitting the latter. This configuration makes it possible to mount the entire contact device in a single manipulation or also in a mechanized manner on the window.

In a particularly advantageous manner, the input connection is made in the form of a sheet cable which is completely covered by the adhesive layer on its side turned towards the window, except for the at least one recess in the region of the contact lands. A particularly large bonding surface is thus created, optimally suitable both as a seal and to relieve the tension.

The adhesive layer is not in general electrically conducting. It must be sufficiently thick to be able to compensate for any irregularities such as curvature of the windows. Appropriate available adhesives can be extruded; they are however also available in the form of sheets, if necessary also with adhesive action on both faces. These acrylic-based adhesives are even approved for exterior applications in the field of motor vehicles and thus guarantee long lifetime in relation to the case of application described here.

It may be judicious to make the adhesive layer thicker at the housing than that of the input connection. The latter will as a general rule be flexible, whilst the housing containing the amplifier and/or other electronic components on a board is rigid and does not adapt to irregularities or to curvatures of the support. This thicker adhesive layer must afford compensation with regard to this point. For this purpose, its consistency is preferably that of a foam with closed pores. For example, adhesives available under the commercial label 3M Loctac 582 may be used here. In the region of the input connection, an adhesive available under the commercial label 3M 966 may for example be used.

To create the galvanic contact between the contact lands of the input connection and the functional element, the usual methods are considered, namely in particular soldering (soft soldering), bonding with conductive adhesives or simply mechanically prestressed contact. The latter can be obtained through an appropriate configuration of elastically deformable contact springs together with a bonded joint with long duration adhesion between the input connection and the support, in which the daubing of the contact zone with an adhesive layer, with appropriate preparation and careful selection of materials, also excludes disturbances caused by moisture or soiling.

According to a second solution in accordance with the invention, the input connection, which can be linked by contact lands to corresponding contact lands of the electrical functional element installed on the window independently of the contact device, is entirely overlainped by the housing after fixing the latter, the contact lands of the two faces being placed in mechanical contact with one another during the installation of the housing. With this solution also, the advantage of extremely simple and reliable mounting is achieved, whilst properly protecting the contact zone against exterior influences.

In an advantageous implementation of this variant, the housing is bonded to the window by means of a high quality adhesive which is leaktight against gases and moisture. Thus, any exterior influence from corrosive media on the contact lands is eliminated. In this variant, it may be sufficient to make provision for sprung contacts alone, if it is certain that the contact lands cannot oxidize during the time between their manufacture and the mounting of the contact device.

In the case of more demanding requirements imposed on the electrical contacts, or if the formation during this time of an oxide layer on the contact lands cannot be excluded, it is possible, according to another implementation, to send energetic radiation to the contact zone so as to place the input connection in contact through fusion with the functional element on the window side; this radiation can reach the contact lands through the housing or from the other side of the window.

The contact lands on the window side may be manufactured in a special embodiment by silk-screen printing; it the energy from the soldering must then be provided in the form of laser radiation, it is then necessary to introduce it through the housing, According to another advantageous implementation, for this purpose this housing has at least one translucent porthole zone and the contact lands covered by the housing are disposed in such a way that they can be reached directly by the energy passing through this cutout.

If conducting tracks of the functional element, which are deposited by silk-screen printing on the window, have to be covered by the adhesive layer, then the latter is, according to an advantageous implementation, thicker than the height of the projection of the conducting tracks on the surface of the window, so as to ensure that no open crevices appear in the region of the said overlap.

The two embodiments of the contact device discussed here are suitable for mechanized mass production.

Other details and advantages of the objective of the invention will ensue from the drawings, each illustrating an exemplary embodiment of the two solutions proposed, as well as from their detailed description which follows.

In a simplified representation,

Figure 1:
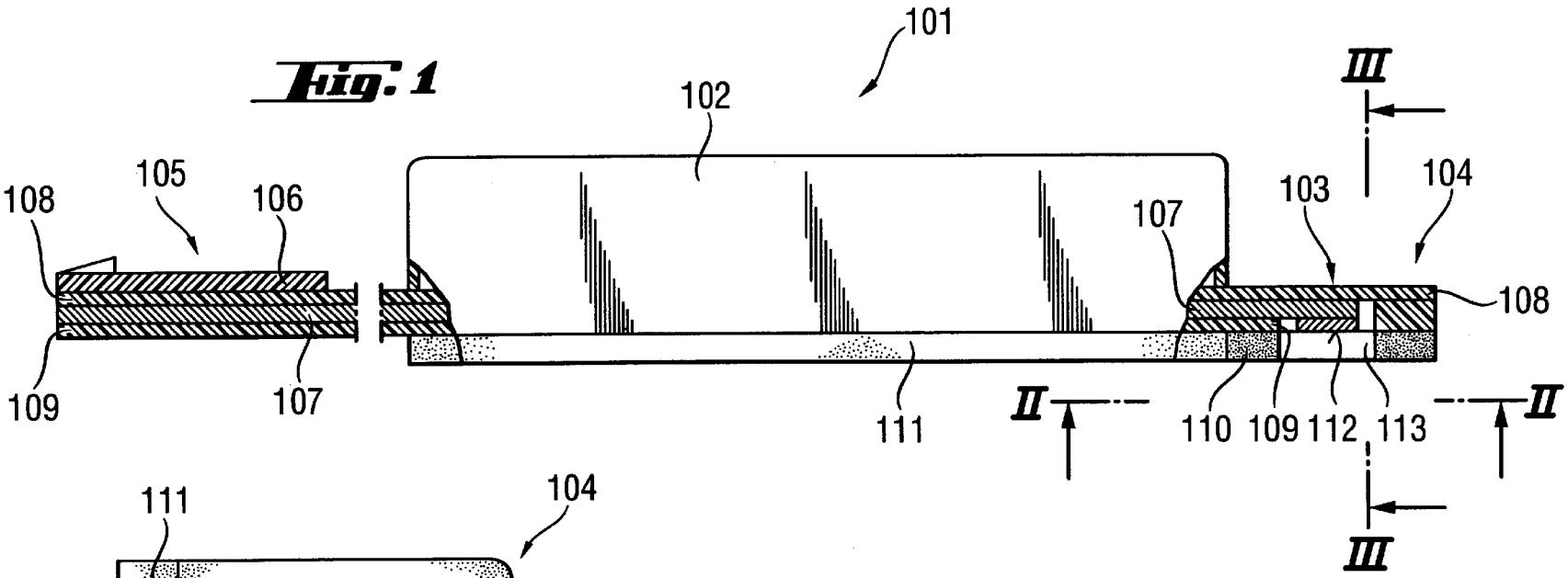
FIG. 1 shows a first embodiment of the contact device in which the input connection is disposed outside the housing.

In accordance with FIG. 1, a contact device 101 essentially comprises a housing 102, on the right side of which is disposed a zone for linking, and respectively an input connection 104, by means of a short segment of a flat cable 103. The latter connection serves for the placing in electrical contact of electrical or electronic components (not represented here) disposed in the housing 101, for example an amplifier, a control circuit or the like, with an electrical functional element 115 disposed on a window (see FIG. 3). The said components do not form part of the present invention, so there is no need to examine them in greater detail.

On the left side of the housing 101 there is again provided a segment of a flat cable as output cable 105. The latter leads for example to a first multiple connector 106 indicated simply here, for example lockable, so as subsequently to link the contact device 101, and respectively the functional element 115, with modules which follow and/or with a current source.

The flat cable 103 is composed, in the customary manner, of several electrical conductors 107—for example in the form of conducting sheets—which are electrically separated from one another by nonconducting insulation layers 108, 109. An adhesive layer 110 is applied to the lower face of the linking zone, respectively of the input connection 104. Another adhesive layer 111 is provided on the lower face of the housing 102. Lastly, the ends of the conductors 107 situated in the region of the input connection 104 are provided with contact lands 112, which may for example be pre-tinned for carrying out soldered joining with corresponding opposing contact lands.

As a variant to this representation, the output cable 105 can also be provided with an adhesive layer and be fixed with the latter onto the surface of the window. In another realization which is not illustrated, it is also possible to cluster the input connection 104 and the output cable 105 into a single contact land. The conducting tracks, and respectively the opposing contact lands of the electrical functional element 113, and the extension cable segments to be joined to the output cable may thus all equally well be made directly on the surface of the window. Alternately, the output cable can be placed in contact from the outside, for example by pushbutton or coaxial contacts.

Figure 2:
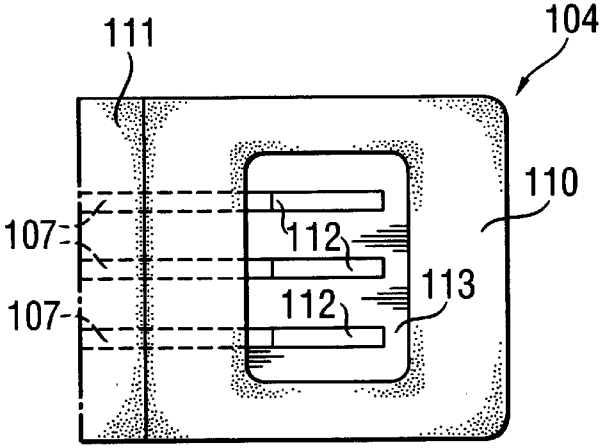
FIG. 2 is a view of the input connection along the line II—II of FIG. 1.

The view from below of the input connection 104 illustrated in FIG. 2 shows clearly that several—here three—electrical conductors 107 enter the linking zone parallel to one another and thus make it possible to employ a corresponding number of contact lands 112. Both the lower insulating layer 109 and the adhesive layer 110 are provided with a recess 113 in the zone surrounding the contact lands. The contact lands 112 are not accessible from the outside, and respectively from below, other than through this recess 113. Laterally, they are surrounded on all sides by the adhesive layer 110, and the upper insulating layer 108 overlies them on top. The join between the adhesive layer 110 and the flat cable 103 covers a large expanse and it is consequently very strong and leaktight. High-strength, long-life adhesives available on the market, preferably approved for the motor industry, are used for making the adhesive layers 110, 111, In the region of the input connection, it is for example possible to use an adhesive available under the commercial label 3M 966, whereas, under the housing, it is for example possible to use an adhesive available under the commercial label 3M Loctac 582.

Figure 3:
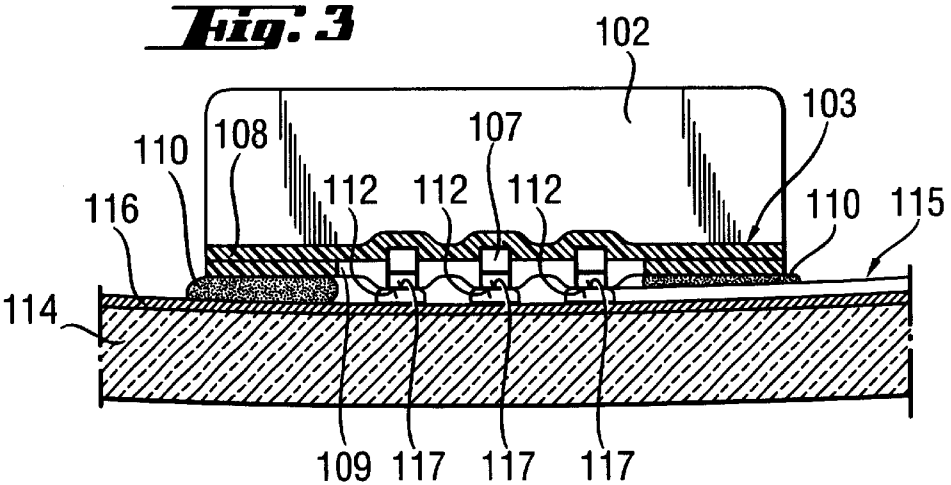
FIG. 3 is an enlarged view along the line III—Ill of FIG. 1, in which the contact device is fixed to a window.

Depicted in FIG. 3 is the position of mounting of the contact device in a lateral sectional view, rotated by 90° with respect to FIG. 1, that is to say looking towards the input connection 104 on the right end face of the housing 102. For a better representation of the linking zone, the latter is represented enlarged with respect to FIGS. 1 and 2. A window 114 carries an electrical functional element 115, which is represented here merely by short segments of conducting tracks. These conducting tracks may lead for example to an antenna or to an electrical heating device. In this exemplary embodiment, they have been deposited on the window, in a known manner, by silk-screen printing followed by firing of a glass/silver conducting frit. They can be deposited either directly on the face of the window or—as is indicated here—in a likewise known manner on an opaque surface overlay 116 The latter then also forms a protection against sight and light in respect of the zone which it overlays, which also comprises in particular the housing 102.

The conducting tracks provided on the window also comprise opposing contact lands 117 in respect of the contact lands 112 of the contact device 101. The latter is installed on the surface of the window by means of adhesive layers 110 and 111, in such a way that the contact lands 112 of its input connection 104 are positioned exactly on the opposing contact lands 117 of the window, and respectively of the functional element. After applying the adhesive layer 110 of the input connection 104 on the surface of the window, this contact zone is rendered leaktight in a very reliable manner against influences (against moisture, soiling, mechanical actions) from outside. If a purely mechanical application force were not to satisfy the demands imposed on the electrical contacts, it would then be possible, with appropriate tools, to provide heat through the upper insulating layer 108 or through the window 114, so as to solder together the contact lands 112 and the opposing contact lands 117. In this case, the two sides should preferably be pre-tinned. The lower insulating layer 109 is notched to form the recess 113.

In this realization, the adhesive layers 110 and 111 have no electrical conduction function. They should however be sufficiently thick to be able to compensate at least for small curvatures and irregularities of the window 114, respectively of the conducting tracks of the functional element 113. This property is indicated in FIG. 3, where the adhesive layer 110 situated above the conducting track leading out rightward from the region of the input connection 104 is more strongly compressed than on the opposite left side.

The other adhesive layer 111 underneath the housing 101 can be made on the whole surface or also, to save material, merely in the form of a frame along the outer perimeter of the housing. This also depends here essentially on the duration of fixed joining of the housing to the window. The latter can be manufactured from glass or synthetic material, be monolithic or a composite product.

Figure 4:
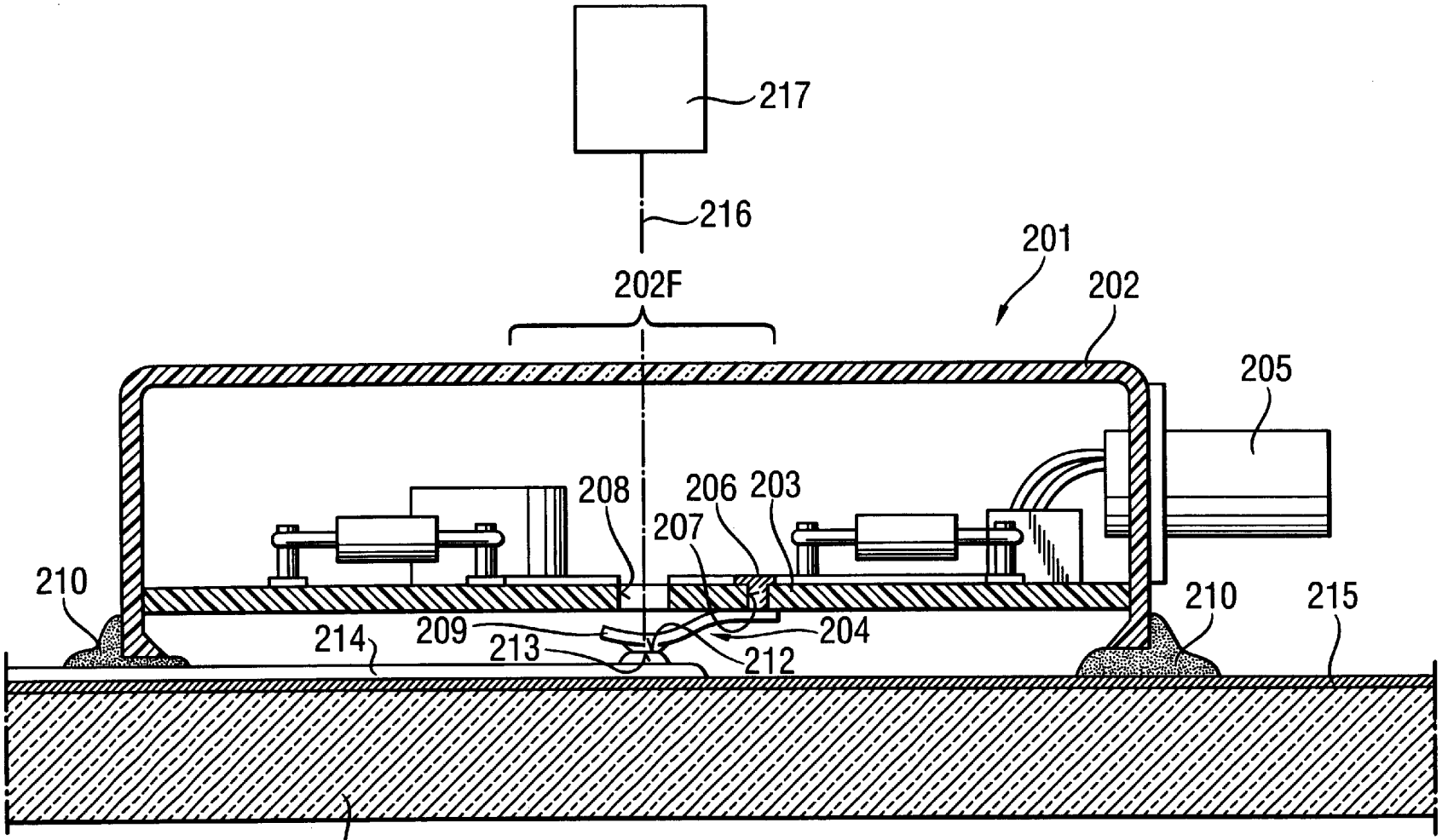
FIG. 4 shows a second embodiment with another arrangement and another realization of the input connection.

The sectional representation of FIG. 4 shows another embodiment in accordance with the invention, with a contact device 201, whose input connection 204 is covered by a housing 202. A coaxial plug 205 is provided on the housing 202 as exterior contact. Disposed in the housing 202 is a board 203 which is decked on its upper face with electrical components and conducting tracks 206. Here this could be an antenna amplifier, which together with a window antenna forms an active radio antenna for motor vehicles. The components represented merely schematically may however also have other functions, for example that of a control circuit for an automatic device for heating the window or the like. This aspect is not examined in greater detail within the framework of the invention to be discussed here, Instead of the coaxial plug 205, the output connection can also—as in the exemplary embodiment discussed above—be provided under the housing alongside the input connection, the corresponding links then also having to be made on the window in the form of plane waveguides.

On the other hand, it is essential for the board 203 to be provided with passages 207 and 208, of which the passage 207 serves to pass an electrical conductor 206 through the plane of the board 203, and the other passage 208 simply forms an opening. The housing 202 is open at its lower face. Therefore, the lower face of the board constitutes, in the premounting state, the lower face of the housing. In the region of the passage 207, the electrical conductor 206 is linked to a contact blade 209, whose free end lies under the passage 208 and forms a contact land 212. If necessary, there may naturally be provision for several contact blades of this type.

The housing 202 is provided, along its lower peripheral edge, with an adhesive layer 210 by means of which it is securely joined to the surface of a window 211. On the same surface there are opposing contact lands for electrically linking the contact device 201 with an electrical functional element (for example the antenna or the window heater already mentioned).

After placing the housing 202 on the window 211, the contact blade bears with slight elastic prestress via its contact land 212 on an opposing contact land 213. The latter can for example be provided at the end of a conducting track 214 deposited by silk-screen printing and fired, which in turn adheres to an opaque layer for protection against sight and light 215. The adhesive layer 210 is again sufficiently thick to be able to adapt with no residual crevice, in the region of the passages of conducting tracks 214, to their projection above the surface.

In favourable circumstances and conditions of use, this elastic contact may suffice, all the more so since there is no fear of harmful influences (in particular corrosive influences) on the contact lands from the surrounding adhesive layer, the leaktight housing and the subjacent window. A prior condition thereof is a working atmosphere of corresponding cleanness when making the connection, and respectively when installing the housing on the window 211.

Preferably, a soldered join is however made between the contact lands. The housing 202 is permeable to laser radiation 216 either throughout its expanse or at least in a porthole zone 202F situated above the passage 208, which radiation is emitted by a semiconductor diode laser 217 or the like indicated in FIG. 4 and which can penetrate the housing 202. For this purpose, the housing is preferably composed of a synthetic material, permeable to the wavelength of the laser (for example 860–890 nm, hence IR or NIR laser), which may be clear or coloured. No component which deviates or absorbs the radiation should be provided between the point of entry of the laser radiation 216 and the passage 208. The radiation 216 thus reaches the upper face of the contact blade 209 without hindrance, through the passage 208. The contact land 212 of the latter blade as well as the opposing contact land 213 may once again be pre-tinned.

Under the action of the energy supplied by the laser, the solder deposits fuse. Elastic prestress of the contact blade creates the mechanical pressure necessary for fusing the two solder deposits, without this requiring the application of an additional load. It may be judicious to furnish the upper face of the contact blade 209, struck by the laser radiation, with a coating which absorbs the latter's wavelength, so that the time of action of the radiation can be minimized while improving the energy capture.

It would also in principle be conceivable to supply the energy necessary for soldering the pre-tinned contact lands by ultrasound wave or induction heating, however only when any degradation of the components fitted in the housing 202 or of the functional element placed on the window side by such a form of energy is excluded.

These could for example be sensitive to more intensive magnetic waves or to stronger vibrations, so that it would then be necessary to prefer energy supply by laser radiation.

All the soldering processes described in relation to the embodiment of FIG. 4 are naturally also applicable to the first embodiment described, with the input connection 104 shifted outside the housing 102.

What is claimed is:

1. A contact device for an electrical functional element disposed on a window, comprising:

a housing fixed on the window;

electrical components provided on said housing;

an input connection configured to connect the electrical functional element with at least one of said electrical components and an output connection, said input connection being formed outside said housing;

an adhesive layer formed between said housing and said input connection, and the electrical functional element, said adhesive layer including at least one recessed portion;

first and second contact lands provided respectively on said input connection and said electrical functional element, said first and second contact lands being in contact for connecting said input connection with said electrical functional element at said recessed portion of said adhesive layer.

2. A contact device according to claim 1, wherein said input connection is in a form of a sheet cable and is completely covered by said adhesive layer on its side turned towards the window, except for said at least one recessed portion.

3. A contact device according to claim 1, wherein a thickness of said adhesive layer at said input connection is less than a thickness of said adhesive layer at said housing.

4. A contact device according to claim 1, wherein said first and second contact lands are coated with a soft solder and, after bonding said adhesive layer to the window, are configured to be soldered using heat and pressure.

5. A contact device according to claim 1, wherein said first and second contact lands are overlaid by an electrically conducting adhesive.

6. A contact device according to claim 1, wherein said first contact lands are configured to contact said second contact lands on the window side, exclusively by a prestress produced when bonding said adhesive layer to the window.

7. A contact device according to claim 1, wherein the electrical functional element includes conducting tracks, printed on the window, which are covered by said adhesive layer, and said adhesive layer is thicker than a projection of the conducting tracks above a surface of the window.

8. A contact device for an electrical functional element disposed on a window, comprising:

a housing fixed on the window;

electrical components and an input connection and an output connection, said input connection connecting the electrical functional element with at least one of said electrical components, and said electrical components and said input connection being included in said housing;

first contact lands in contact with said input connection and configured to contact second contact lands of the electrical function element, wherein said first contact lands and said input connection are entirely overlaid by said housing; and wherein said input connection includes at least one elastic contact blade in contact with said first contact lands and configured to be elastically prestressed.

9. A contact device according to claim 8, wherein said first contact lands are a soft solder.

10. A contact device according to claim 9, wherein said housing includes at least a limited region permeable to high energy radiation, and said first contact lands overlaid by said housing are disposed to be reached directly by energetic radiation passing through said limited region.

11. A contact device according to claim 10, wherein the high energy radiation is supplied in a form of a heat of electromagnetic induction.

* * * * *